US006273259B1

(12) United States Patent
Stahl

(10) Patent No.: US 6,273,259 B1
(45) Date of Patent: Aug. 14, 2001

(54) CONTAINER

(75) Inventor: Edward L. Stahl, Bullard, TX (US)

(73) Assignee: Norseman Plastics Limited, Rexdale (CA)

( * ) Notice: Subject to any disclaimer, the term of this patent is extended or adjusted under 35 U.S.C. 154(b) by 0 days.

(21) Appl. No.: 09/567,266

(22) Filed: May 9, 2000

(51) Int. Cl.[7] ..... B65D 21/04
(52) U.S. Cl. ..... 206/511; 206/509
(58) Field of Search ..... 206/511, 509, 206/512

(56) References Cited

U.S. PATENT DOCUMENTS 3,907,111 * 9/1975 Levenhagen ..... 206/511
4,194,626 * 3/1980 Boller ..... 206/511
5,344,022 * 9/1994 Stahl ..... 206/511
5,752,602 * 5/1998 Ackermann et al. ..... 206/511
5,816,406 * 10/1998 Tupille et al. ..... 206/511
5,860,527 * 1/1999 Frankenberg et al. ..... 206/511
5,896,897 * 4/1999 Bettenhausen ..... 206/511

* cited by examiner

*Primary Examiner*—Joseph M. Moy
(74) *Attorney, Agent, or Firm*—Katten Muchin Zavis

(57) ABSTRACT

A novel container for transport or storage of products such as bread, buns, or other goods. In one embodiment, there is provided a nestable container with a base and sidewalls that can be stacked in two positions for different products and can be nested when empty for compact storage. The container has levered positions for lifting out of each stacking position and into a corresponding sliding position. The sliding positions can be used to offset the container or containers from the stack and reduce the strain on the operator when lifting for destacking. Alternatively, the container can slide in the opposite direction for stacking in either position. Thus the operator can set the container down, offset from the stack, in the sliding position and slide into stacking position. Back strain can be reduced during stacking and destacking as the operator does not have to extend or lean over the stack to pick up or set down the containers.

19 Claims, 19 Drawing Sheets

CONTAINER

FIELD OF THE INVENTION

The present invention relates to injection molded containers. In particular, the present invention relates to a transport and storage container.

BACKGROUND OF THE INVENTION

Many transport and storage containers are known. Certain containers are used to transport and store goods such as bread or buns and other foods. Containers are typically injection molded plastic and rectangular in shape.

Containers for transportation and storage of bread products commonly have a base with a protruding base edge, a pair of opposing long sidewalls, and a pair of opposing short sidewalls. The sidewalls protrude in the opposite direction of the base edge. The opposing long sidewalls generally do not protrude as far from the base as the short sidewalls and may have a merchandiser or open section for viewing the contents held therein. The containers are stackable such that the base edge of one container is typically received by a complimentary configuration on the opposing short sidewalls of a second container. The base of the container can have a plurality of apertures for material and weight reduction. Similarly, each short sidewall commonly has a plurality of apertures and a handle in the centre for gripping the container.

When stacking, the container is gripped by placing one hand on each handle. The container is centred above a second container and placed directly down such that the base edge of the first container is received by the footprint of the second container. Similarly, when removing one container from a stack, the container is gripped by placing one hand on each handle. The container is then lifted away from and in a direction normal to the complimentary container. Because of the configuration of the container, stacking and destacking can be awkward and ergonomically unsafe as the person lifting the container can experience lower back strain. The operator carries the load with extended arms to place the container into a stack or when removing from a stack. The container is even more awkward to destack when full. If the operator removes more than one container when destacking, the potential for back strain is further increased.

When moving many containers at one time, a two wheeled cart is typically used. In order to slide the blade edge of the cart under the container it is generally preferred to tilt the stack of containers so that the blade will run under the stack. A stack of containers can be difficult to tilt forward while manoeuvring a two wheeled cart into place. It can be even more difficult to tilt the stack of containers due to lack of space in a packed truck. The cart also applies pressure to the base of the bottom container of the stack. This causes flexing of the base of the container thus crushing the contents of the bottom container. Overall, using a two wheeled cart to lift a stack of containers can be awkward and/or can damage the container.

SUMMARY OF THE INVENTION

It is an object of the present invention to provide a novel container that obviates or mitigates at least one of the disadvantages of the prior art.

In one aspect of the invention there is provided a container with a base and at least one pair of opposing sidewalls. The sidewalls have a rail edge distal from the base and a plurality of receptacles. The sidewalls have runners complementary to the receptacles that project from an edge adjacent the base. The sidewalls also have a fulcrum at the junction of a rail edge and one of the receptacles. The container has a stacked position with an identical container when the runners are received in complementary receptacles of the identical container. The container has a sliding position when the runners abut a rail edge of the identical container. The container has a levered position intermediate the stacked and sliding positions when the runner respective to a fulcrum of the identical container is pivoted thereon. In a preferred embodiment of the first aspect, there are two outer runners, or feet, and a central runner respective to the fulcrum.

In a second aspect of the invention there is provided a container with a base and at least one pair of opposing sidewalls projecting normally from the base. The sidewalls have a base edge proximal to the base and a distal edge opposite the base edge. One of the base edge and the distal edge has a plurality of receptacles and the opposite one has a plurality of runners complementary to the receptacles. The sidewalls also have a fulcrum at a junction of one of the receptacles and the respective edge. The container has a stacked position with an identical container when the runners are received in complementary receptacles of the identical container. The container has a sliding position when the runners abut the opposite edge of the identical container. The container has a levered position intermediate the stacked and sliding positions when the runner respective to the fulcrum of the identical container is pivoted thereon.

In a third aspect of the invention there is provided a container with a base and a pair of opposing sidewalls projecting normally from the base. A pair of opposing long walls project normally from the base and extend between the pair of opposing sidewalls. A skirt around the periphery of the base interconnects the base with the sidewalls and the base with the long walls. The skirt is further defined by an outward taper and a pair of notches between each of the long sides and the base. The base comprises a grid of interconnected, inverted u-shaped channels. The unshaped channels have at least one closed end and two opposing sides. The sidewalls have a rail and a rail edge distal from the base. The rail edge has a plurality of foot receptacles with a bevelled edge and at least one runner receptacle. The sidewalls have feet with a bevelled edge that are complementary to the foot receptacles and project from an edge proximal to the base. The sidewalls have at least one runner complementary to the runner receptacle that projects from the edge proximal to the base. Each of the opposing sidewalls have at least one handle with finger grips on one of the opposing sidewalls. One of the opposing sidewalls also has a serrated edge distal from the base and adjacent to the rail. The container has a fulcrum at a junction of the rail edge and the runner receptacle. The container has a first stacked position with an identical container when the feet are received in complementary foot receptacles of the identical container and the runner is received in complementary runner receptacle of the identical container. The container has a first sliding position, in relation to a second identical container, when the runner abuts the rail edge of the identical container. The container also has a first levered position, in relation to a second identical container, that is intermediate the first stacked and first sliding positions and the runner respective to a fulcrum of the identical container is pivoted thereon. The container has a second stacking position when the feet are received in complementary foot receptacles of an opposite sidewall of the identical container. The container has a second sliding position when the feet abut the rail on the opposite sidewall of the identical container. The container also has a second levered position intermediate the second stacked and second sliding positions when one of the feet respective to one foot receptacle on the opposite sidewall of the second container is pivoted thereon.

A novel container for transport or storage of products such as bread, buns, or other goods. In one embodiment, there is provided a nestable container with a base and sidewalls that can be stacked in two positions for different products and can be nested when empty for compact storage. The container has levered positions for lifting out of each stacking position and into a corresponding sliding position. The sliding positions can be used to offset the container or containers from the stack and reduce the strain on the operator when lifting for destacking. Alternatively, the container can slide in the opposite direction for stacking. Thus the operator can set the container down (offset from the stack) in the sliding position and then slide into stacking position. Back strain can be reduced during stacking and destacking as the operator does not have to extend or lean over the stack to pick up or set down the containers.

BRIEF DESCRIPTION OF THE DRAWINGS

Preferred embodiments of the present invention will now be described, by way of example only, with reference to the attached Figures, wherein.

DETAILED DESCRIPTION OF THE INVENTION

Figure 1:
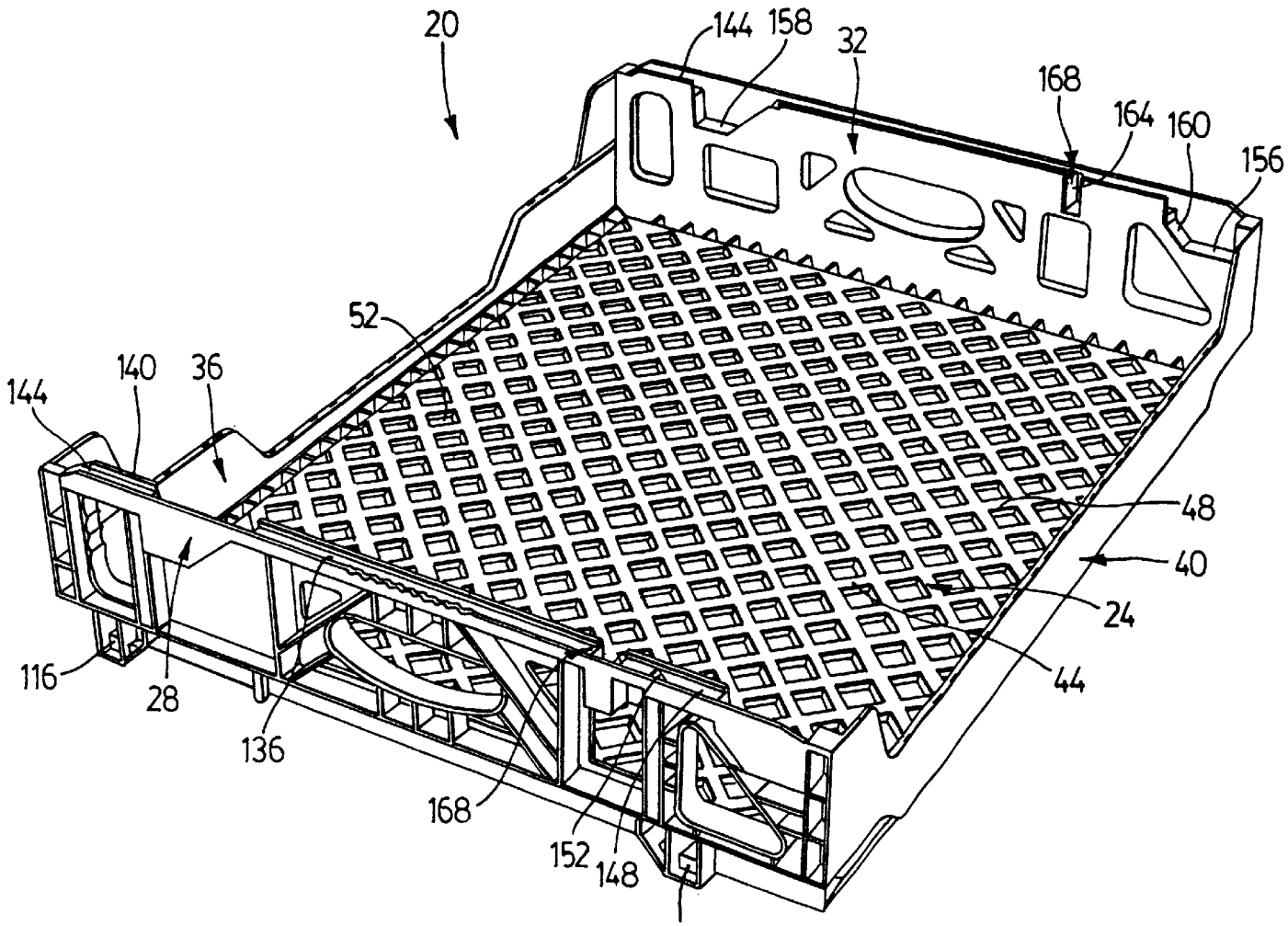
FIG. 1 is a top perspective view of the container, in accordance with a first embodiment of the invention.

Referring to FIG. 1, a container in one embodiment of the invention is indicated generally at 20. Container 20 is preferably used to transport and/or store products such as bread or buns. In a present embodiment, container 20 is an injection-molded polymer such as high-density polyethylene but other materials and forming processes can be used. Container 20 comprises a substantially rectangular base 24 and two sidewalls 28, 32 that project substantially normal to base 24. Opposing long sides 36, 40 extend between sidewalls 28, 32 and project substantially normal to base 24.

Figure 2:
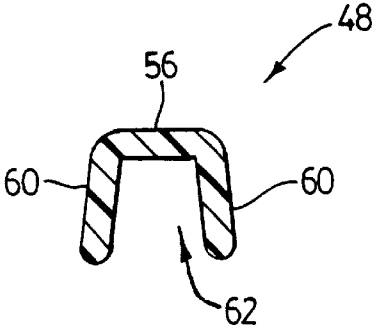
FIG. 2 is a sectional view of the unshaped channel of the base of the container of FIG. 1.

Base 24 is slightly bowed such that it has a convex side 44 towards the interior of container 20. Base 24 is comprised of a grid of interconnected inverted u-shaped channels 48. The grid of u-shaped channels 48 forms a plurality of apertures 52 in base 24. As best seen in FIG. 2, u-shaped channels 48 have a closed end 56 and two opposing sides 60 extending therefrom. Closed end 56 and opposing sides 60 form channel opening 62. Channel 48 is tapered such that each of opposing sides 60 is at an obtuse angle with end 56. It is believed that the angle can be from about one degree to about fifteen degrees with respect to the normal from closed end 56. Preferably, the angle is from about two degrees to about ten degrees with respect to the normal from closed end 56. More preferably, the angle is about three degrees with respect to the normal from closed end 56.

Figure 3:
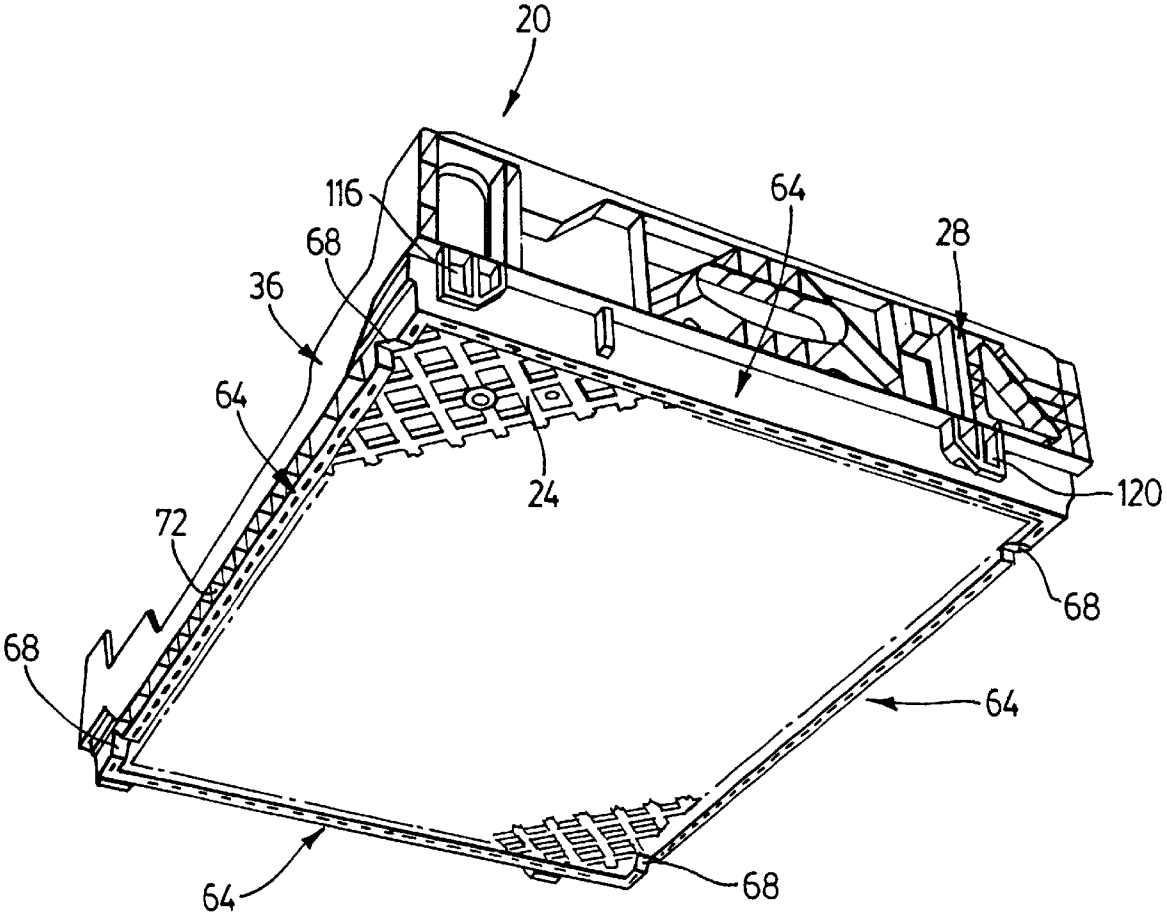
FIG. 3 is a bottom perspective view of the container of FIG. 1.

Referring to FIG. 3, a skirt 64 runs along the periphery of base 24 and interconnects base 24 with sidewalls 28, 32 and long sides 36, 40. There are two notches 68 in skirt 64 between each of long sides 36, 40 and base 24.

Figure 4:
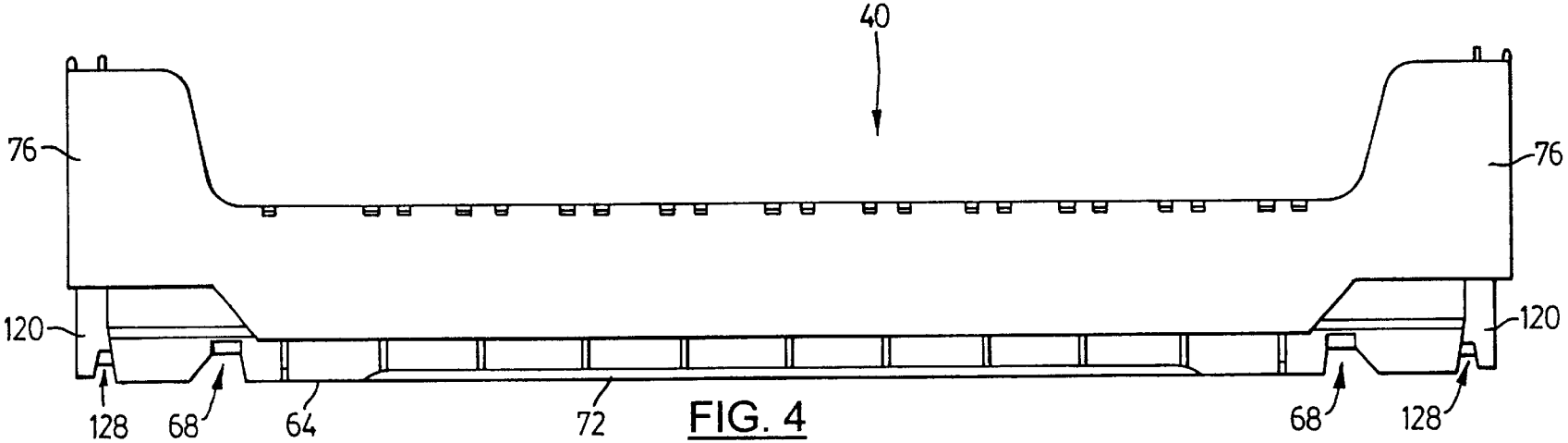
FIG. 4 is a rear view of the container of FIG. 1.
Figure 5:
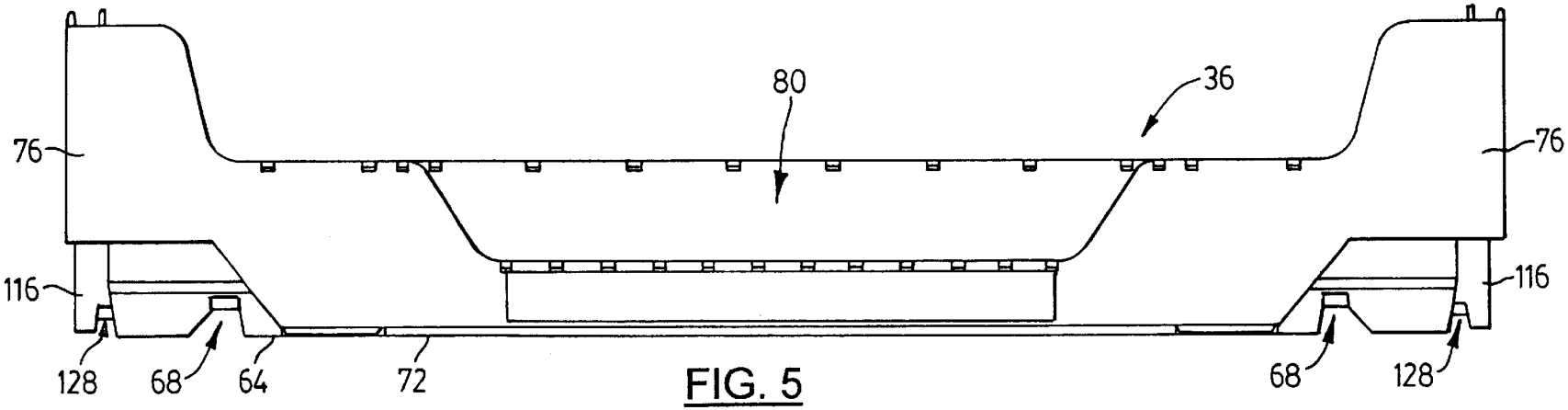
FIG. 5 is a front view of the container of FIG. 1.

Referring now to FIGS. 4 and 5, long side 40 is substantially rectangular with a flange 76 on each end adjoining sidewalls 28, 32. Similarly, long side 36 has flange 76 on each end adjoining sidewall 28, 32. A substantially rectangular merchandiser window 80 is framed by long side 36 and flanges 76. Skirt 64 is further defined by an outward taper 72 that runs adjacent to long sides 36, 40 and is for slideably receiving the blade of a two-wheeled cart.

Figure 6:
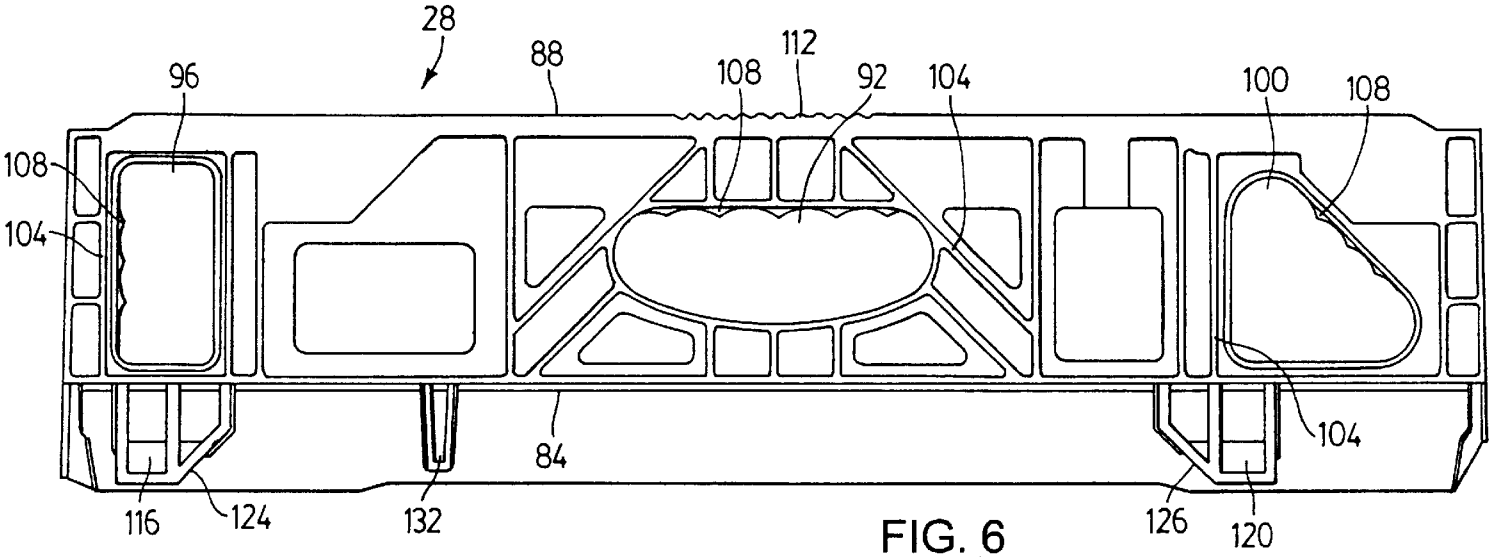
FIG. 6 is a right side view of the container of FIG. 1.
Figure 7:
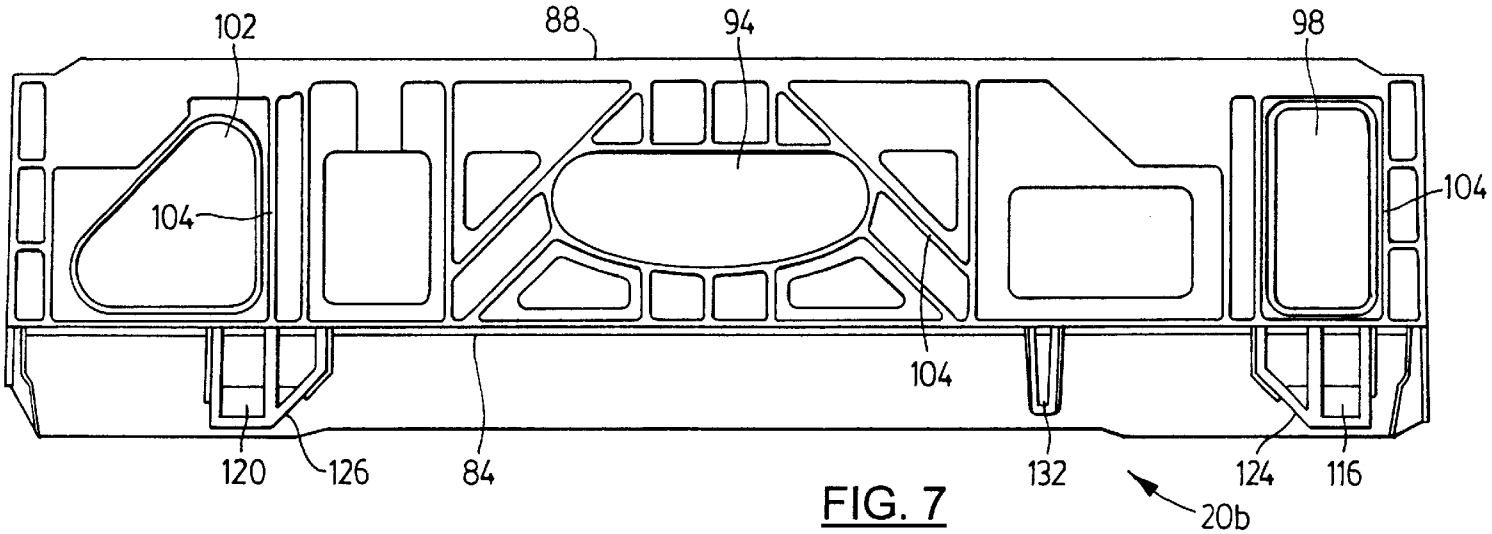
FIG. 7 is a left side view of the container of FIG. 1.

Referring to FIGS. 6 and 7, sidewalls 28, 32 are substantially rectangular with a base side 84 and a rail side 88 opposite base side 84. Sidewall 28 has a central handle 92 substantially centred on sidewall 28. Also, sidewall 28 has a rectangular end handle 96 at one end and a triangular end handle 100 at the opposite end. Similarly, sidewall 32 has a central handle 94 substantially centred on sidewall 32. Also, sidewall 32 has a rectangular end handle 98 at one end and a triangular end handle 102 at the opposite end. Each sidewall 28, 32 has ribs 104 proximal to each handle 92, 96, 100, 94, 98, 102 for supporting sidewalls 28, 32 and handles 92, 96, 100, 94, 98, 102. Sidewall 28 is substantially the mirror-image of sidewall 32. However, sidewall 28 has finger grips 108 respective to each handle 92, 96, 100, and a serrated edge 112, each of which can be used to identify sides 28, 32.

Referring to FIGS. 4, 5, 6 and 7, a first guide foot 116 extends from base side 84 of each sidewall 28, 32 and is substantially aligned with rectangular handle 96, 98. Guide foot 116 is substantially rectangular with an inwardly facing bevelled edge 124. A second guide foot 120 extends from base side 84 of each sidewall 28, 32 and is closer to central handle 92 than first guide foot 116. Each guide foot 120 is substantially rectangular with an inwardly facing bevelled edge 126. Each foot 116, 120 has a groove 128 between its extremity and skirt 64.

As best seen in FIG. 6, a substantially rectangular runner 132 is integral with skirt 64 and projects from base side 84. Runner 132 is substantially centred between central handle 92 and rectangular end handle 96. As best seen in FIG. 7, sidewall 28 and its respective guide feet 116, 120 and runner 132 are substantially the mirror image of sidewall 32.

Figure 8:
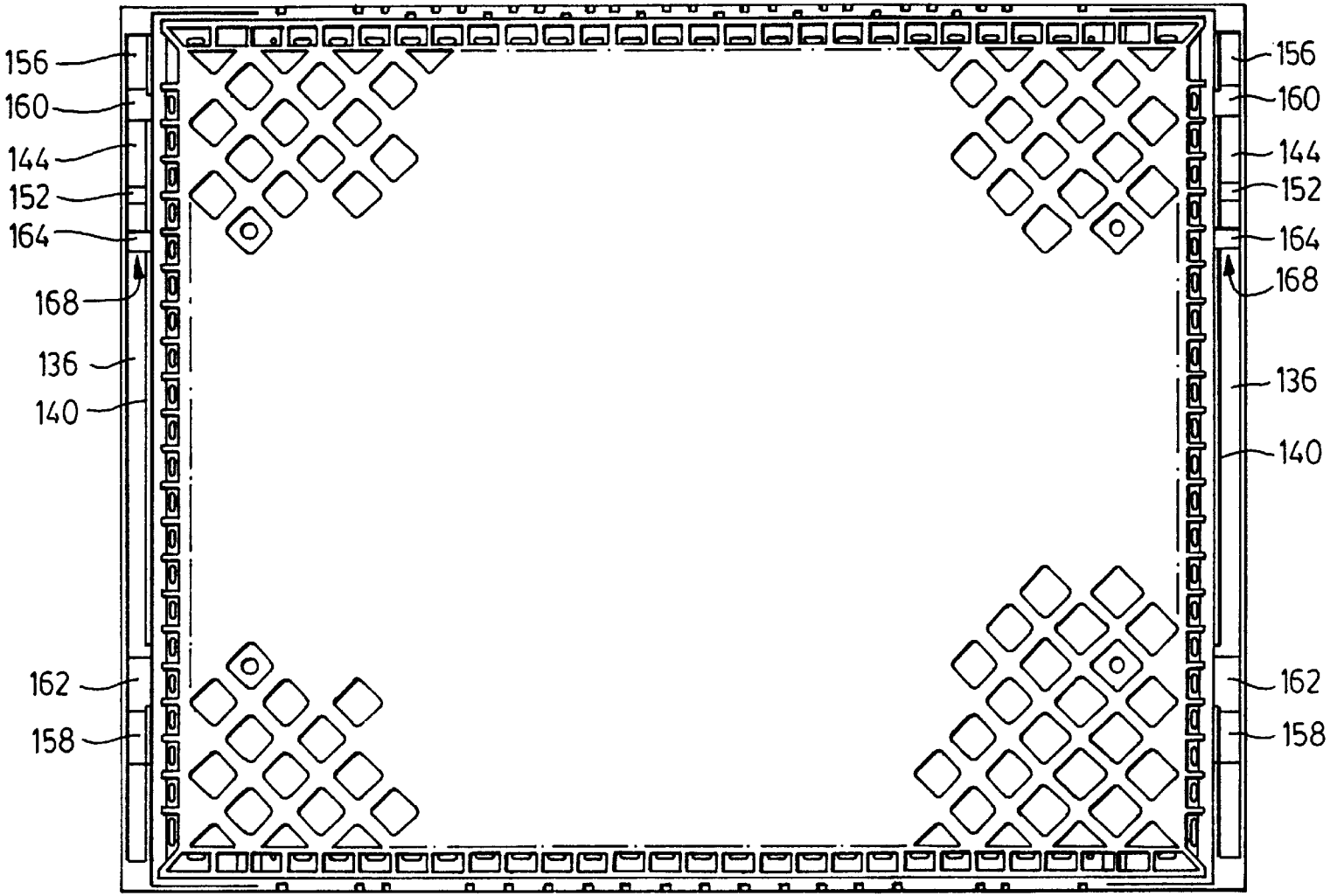
FIG. 8 is a top view of the container of FIG. 1.

As best seen in FIGS. 1 and 8, a rail 136 is recessed from a rail edge 140 and extends substantially along the inner length of each sidewall 28, 32 on rail side 88. Each rail 136 has a first depression 144 aligned with guide foot 116 on each of sidewalls 28, 32. Similarly, each rail 136 has a second depression 148 aligned with second guide foot 120 on each of sidewalls 28, 32. Second depression 148 has an inwardly bevelled edge 152 between depression 148 and rail 136. Each rail 136 has a first foot receptacle 156 proximal to long side 40 with an inwardly bevelled edge 160. Each rail 136 has a second foot receptacle 158 with an inwardly facing bevelled edge 162. Second foot receptacle 158 is closer to central handle 92 than first foot receptacle 156. Also, each rail 136 has a runner receptacle 164. A fulcrum 168 intersects receptacle 164 and rail edge 140 on the side of receptacle 164 nearest to central handle 92 on each sidewall 28, 32.

The positions for transportation and storage of container 20 will now be described with reference to the foregoing and the attached Figures. Container 20 has two stacked positions shown in FIGS. 9*a* to 9*d* and FIGS. 12*a* to 12*d*, two levered positions for destacking shown in FIGS. 10 and 13, two sliding positions for stacking and destacking shown in FIGS. 11 and 14, and a nested position for storage shown in FIG. 15. In each of the above listed positions, container 20 is positioned with an identical container 20*b*. Note that all parts of container 20*b* are given the same number designations as that of container 20 but are succeeded by the label "b".

In the first stacked position, shown in FIGS. 9*a* to 9*d*, container 20 is stacked with container 20*b* such that side 28 is aligned with side 32*b*. Likewise, side 32 is aligned with side 28*b*. Each guide foot 116, 120 is received by complimentary foot receptacle 156*b*, 158*b*. Bevelled edge 124 of each guide foot 116 is adjacent to bevelled edge 160*b* of complimentary foot receptacle 156*b*. Similarly, bevelled edge 126 of each guide foot 120 is adjacent to bevelled edge 162*b* of complimentary foot receptacle 158*b*. Each runner 132 is received by complimentary runner receptacle 164*b*. In this configuration, central handle 92 is aligned with central handle 94*b*. End handles 96, 96*b*, 100, 100*b*, 98, 98*b*, 102, 102*b* are oppositely aligned such that rectangular handle 96 is aligned with triangular handle 102*b* and triangular handle 100 is aligned with rectangular handle 98*b*. Similarly, central handle 94 is aligned with central handle 92*b*. Triangular handle 102 is aligned with rectangular handle 96*b* and rectangular handle 98 is aligned with triangular handle 100*b*. Serrated edges 112 and 112*b* are on opposing sides of stacked containers 20, 20*b*. As will now be apparent to those of skill in the art, a plurality of substantially identical containers 20 can be stacked together in the first stacked position.

Figure 9A:
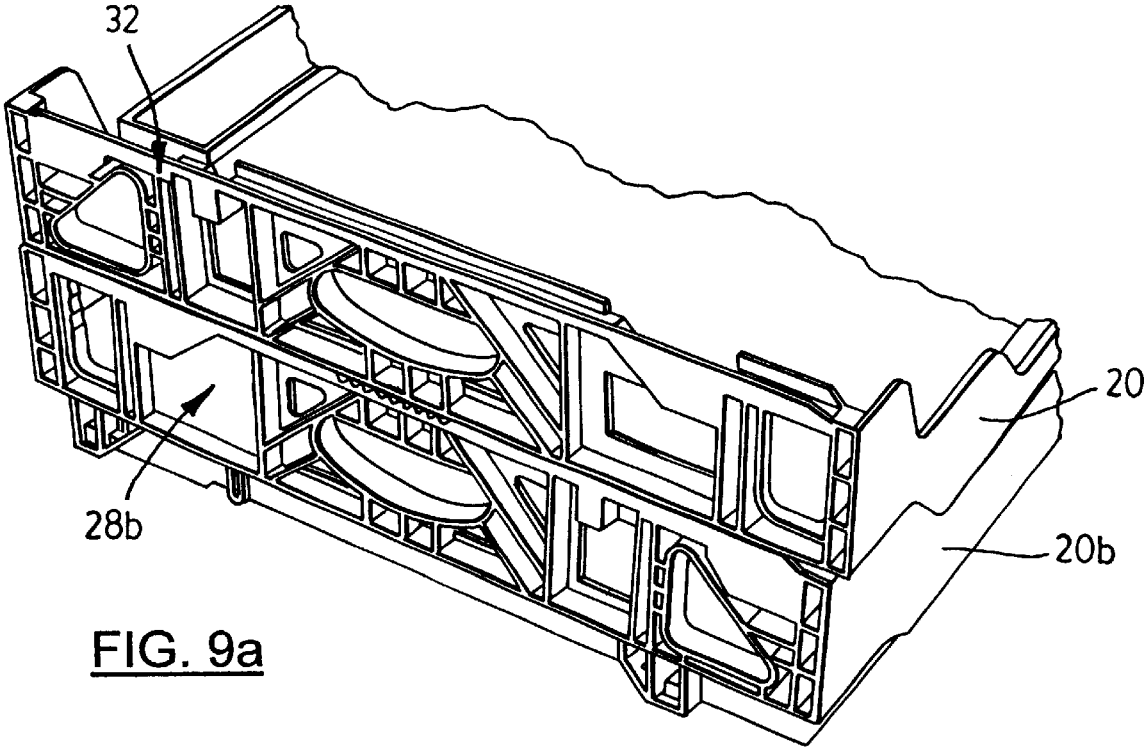
FIG. 9*a* is a partial perspective view of two of the containers of FIG. 1, stacked in first stacking position.
Figure 9B:
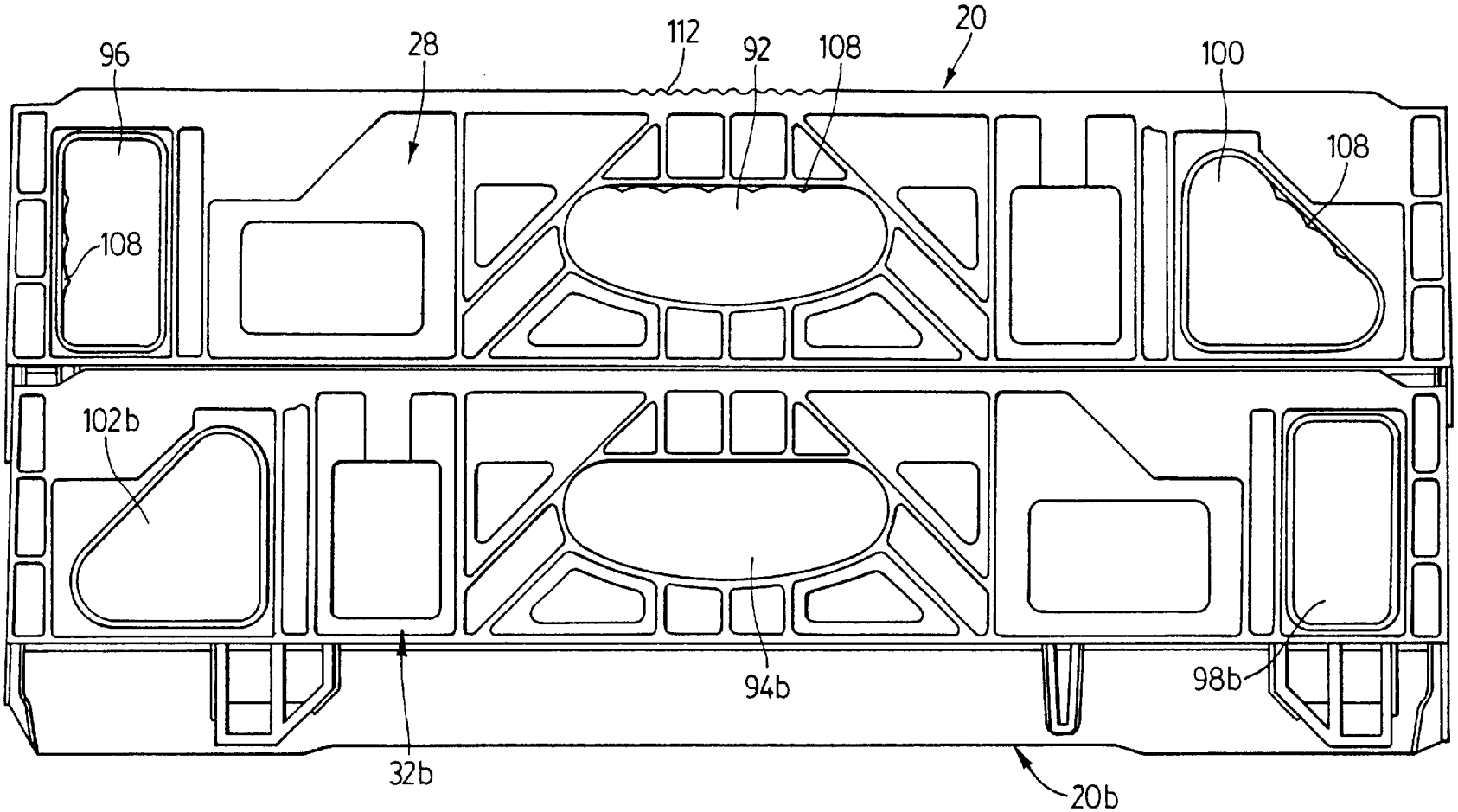
FIG. 9*b* is a side view of two of the containers stacked in a first stacking position.
Figure 9C:
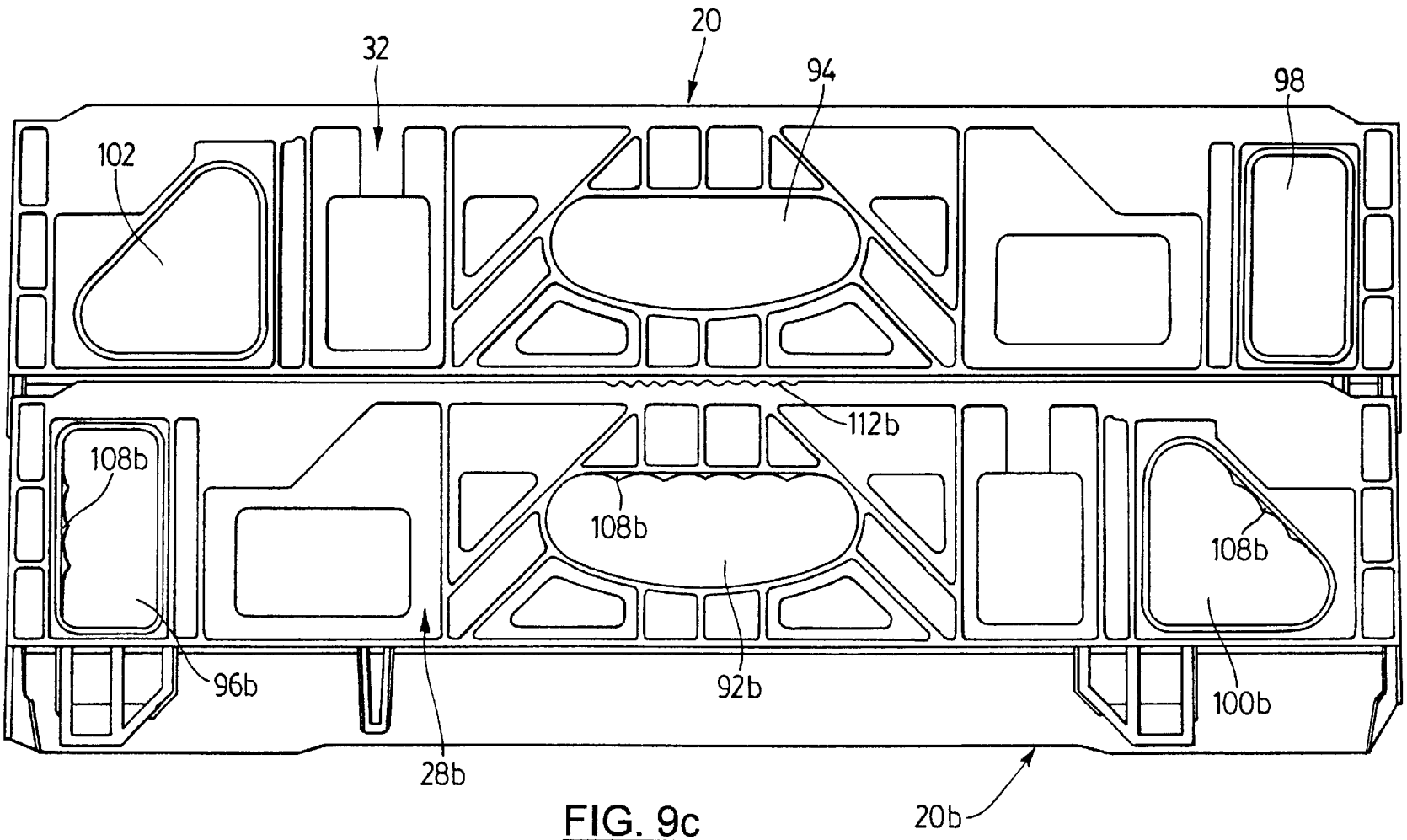
FIG. 9*c* is a side view, opposite the side view of FIG. 9*b*, of two of the containers stacked in the first stacking position.
Figure 9D:
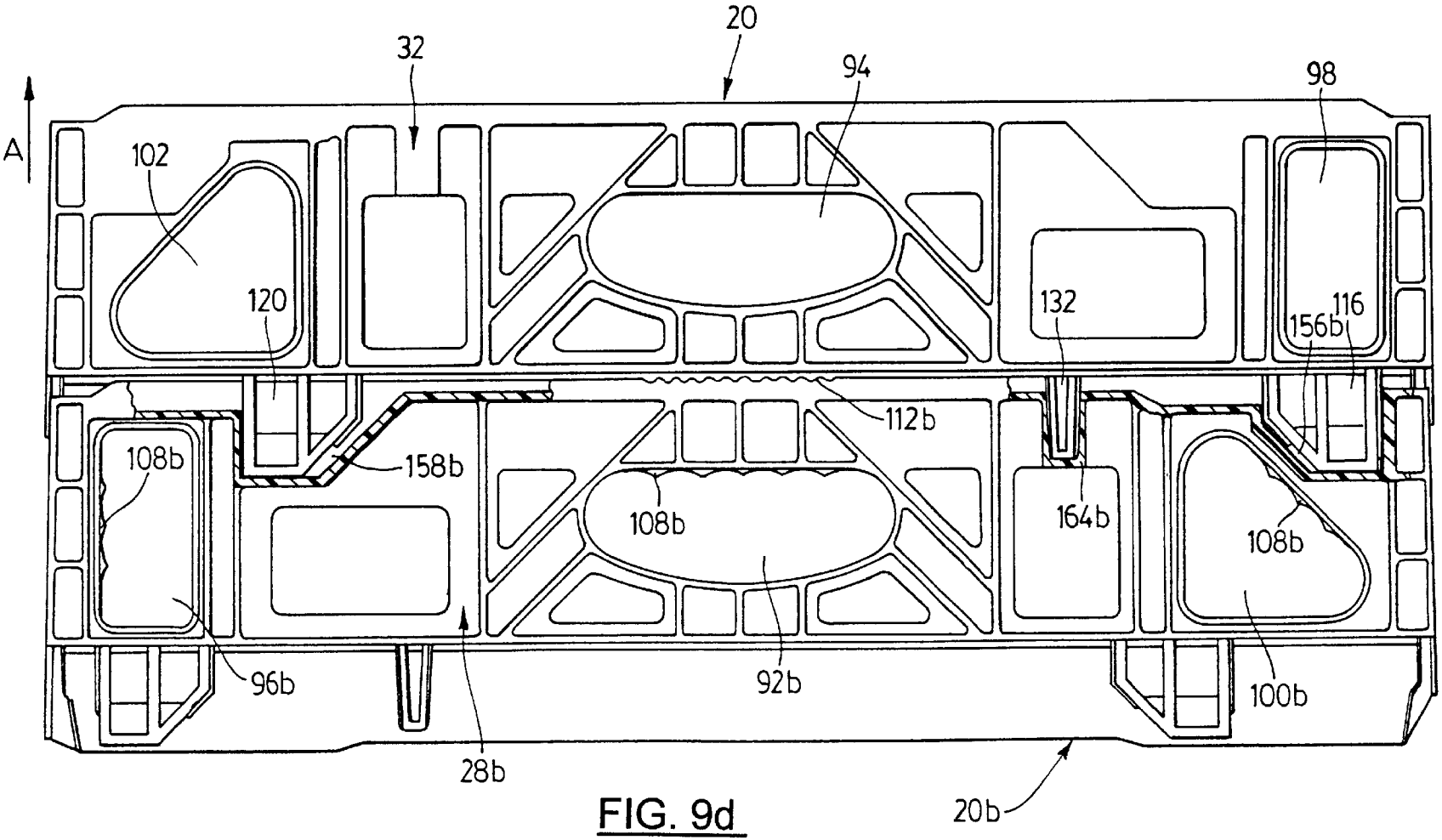
FIG. 9*d* is a partial sectional side view of two of the containers stacked in the first stacking position shown in FIG. 9*c;*
Figure 10:
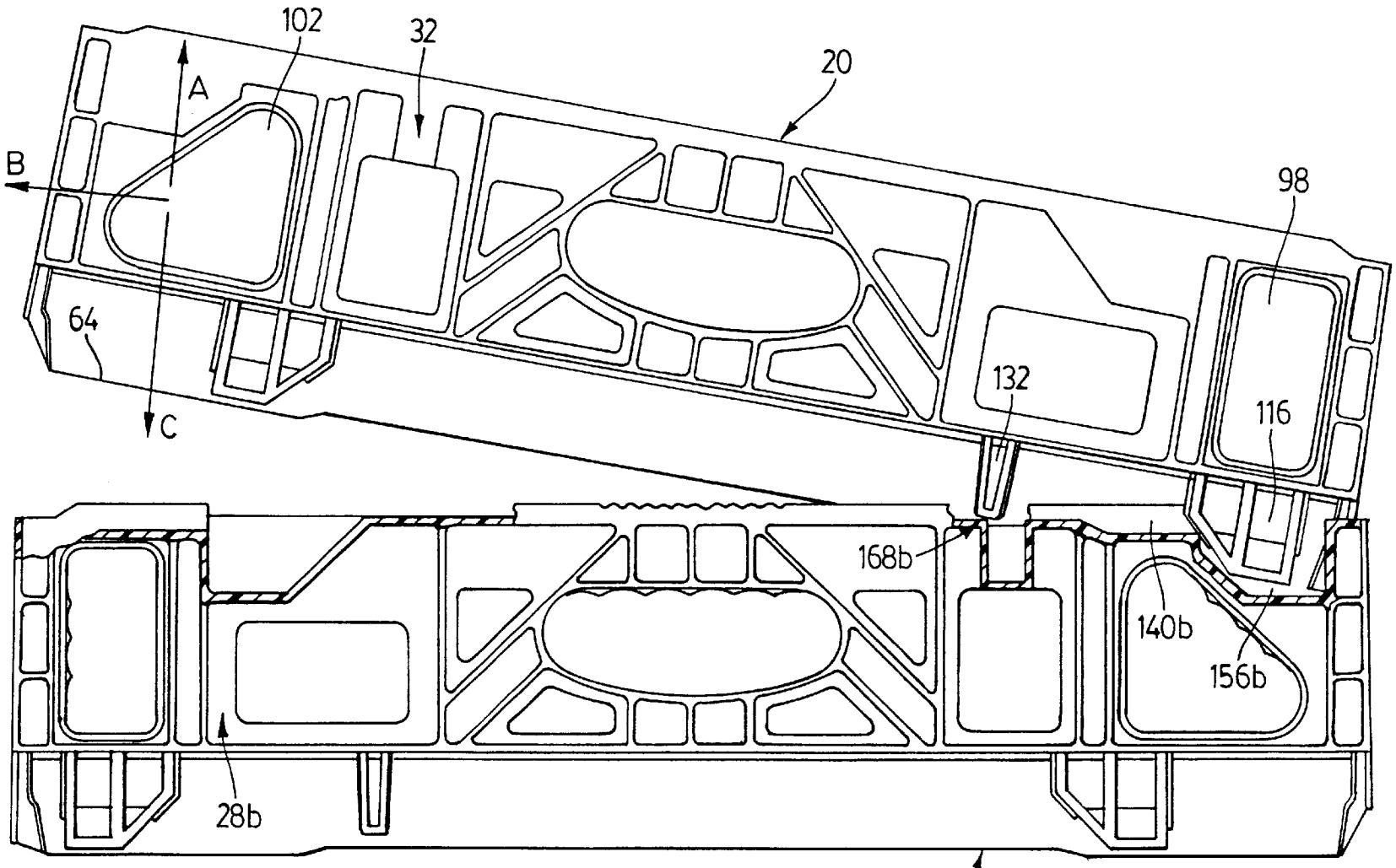
FIG. 10 is the partial sectional side view of FIG. 9*c* showing the first container in a first levered position with respect to the second container.
Figure 11:
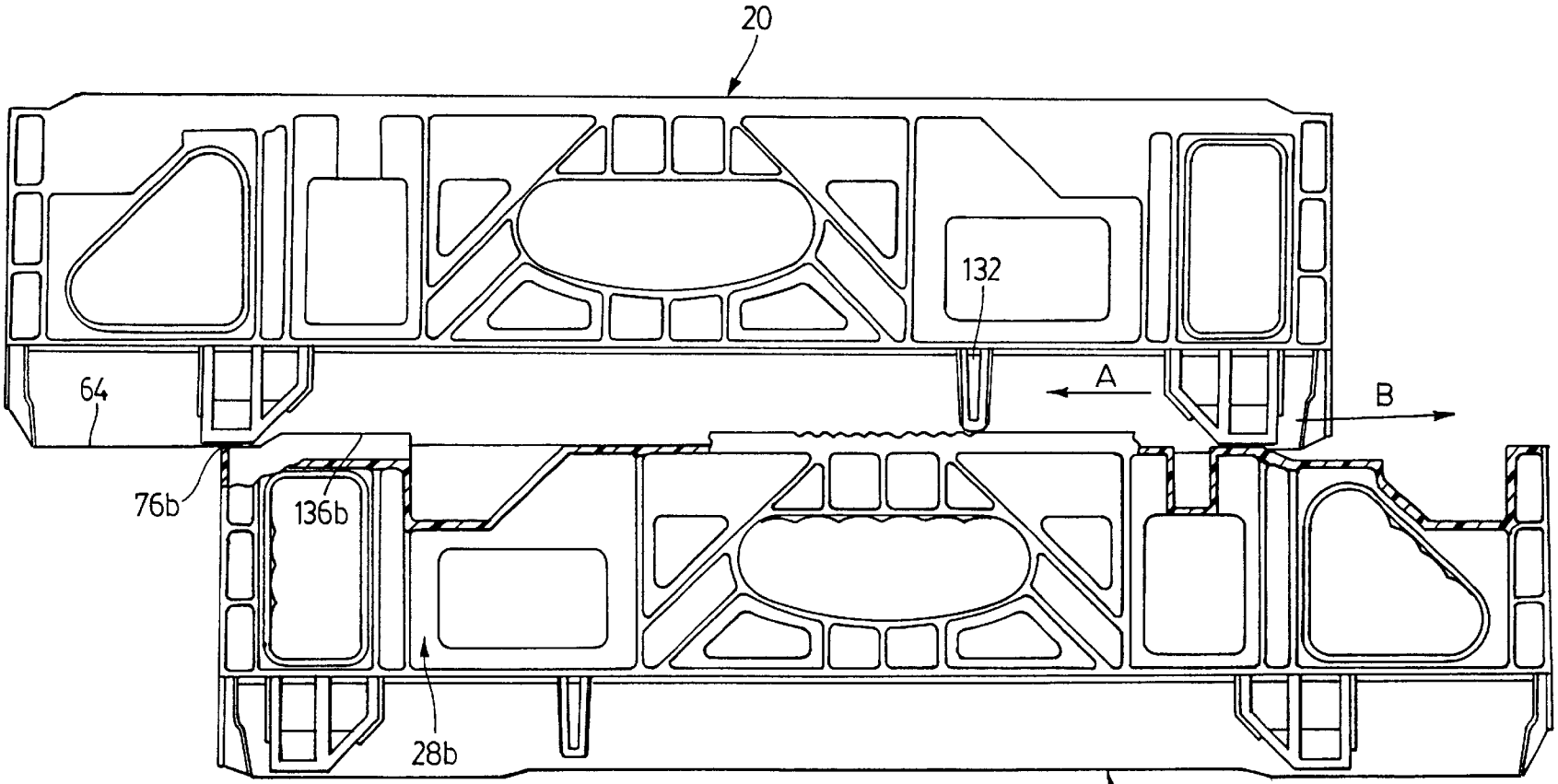
FIG. 11 is the partial sectional side view of FIG. 9*c* showing the first container in a first sliding position with respect to the second container.

Container 20 can be levered out of the first stacked position and into the first sliding position when destacking. From the first stacked position as shown in FIG. 9*d*, triangular handles 100, 102 of container 20 are grasped and container 20 is urged in the direction of arrow A. The opposing ends of sidewalls 28, 32, nearest rectangular handles 96, 98 maintains contact with respective ends of sidewalls 32*b* and 28*b* of container 20*b*. Referring to FIG. 10, container 20 is advanced in the direction of arrow B until guide foot 116 contacts rail edge 140*b*. Container 20 is then lowered in the direction of arrow C such that runner 132 contacts fulcrum 168*b*. Container 20 is urged in the direction of arrow C while a force is applied in the direction of arrow B, thereby maintaining contact between runner 132 and fulcrum 168*b* and lifting each first guide foot 116 out of respective receptacles 156*b*. When container 20 is seated again on container 20*b*, runner 132 is seated on rail 136*b* and skirt 64 is seated on flanges 76*b* of long side 40*b*, as best seen in FIG. 11. This is the first sliding position.

Referring to FIG. 11, container 20 is in the first sliding position with runner 132 seated on rail 136*b* and skirt 64 seated on flanges 76*b*. Container 20 can be urged in the direction of arrow A, for destacking or arrow B for stacking, sliding runner 132 along rail 136*b* and skirt 64 along flanges 76*b*. With a plurality of substantially identical containers 20 in a stack, container 20 can be destacked by sliding in the direction of arrow A. Container 20 is thus offset from the stack and the operator can lift container 20 by grasping central handles 92, 94. Offsetting container 20 from the stack before lifting can allow the operator to remain substantially upright, without bending, when lifting the container. Alternatively, container 20 can be seated in the sliding position and then urged in the direction of arrow B for stacking, again allowing the operator to remain substantially upright. In the second stacked position, shown in FIGS. 12*a* to 12*d*, container 20 is stacked with container 20*b* such that sidewall 28 is aligned with sidewall 28*b*. Likewise, sidewall 32 is aligned with sidewall 32*b*. On each of sidewall pairs 28, 28*b* and 32, 32*b*, guide foot 116 is seated on complimentary rail depression 144*b*. Guide foot 120 is seated on complimentary rail depression 148*b*. Bevelled edge 126 of guide foot 120 is adjacent to bevelled edge 152*b* of depression 148*b*. Runner 132 is adjacent rail edge 140*b*. Guide foot 116 is aligned with guide foot 116*b* and guide foot 120 is aligned with guide foot 120*b*. Runner 132 is aligned with runner 132*b*. In this configuration, central handle 92 is aligned with central handle 92*b*. Rectangular end handles 96 and 96*b* are aligned, triangular end handles 100 and 100*b* are aligned, and serrated edges 112 and 112*b* are aligned. Similarly, central handles 94 and 94*b* are aligned, rectangular handles 98 and 98*b* are aligned, and triangular handles 102 and 102*b* are aligned. The distance between base 24 and base 24*b* is greater in the second stacked position than in the first stacked position. As will now be apparent to those of skill in the art, a plurality of substantially identical containers 20 can be stacked together in the second stacked position.

Figure 12A:
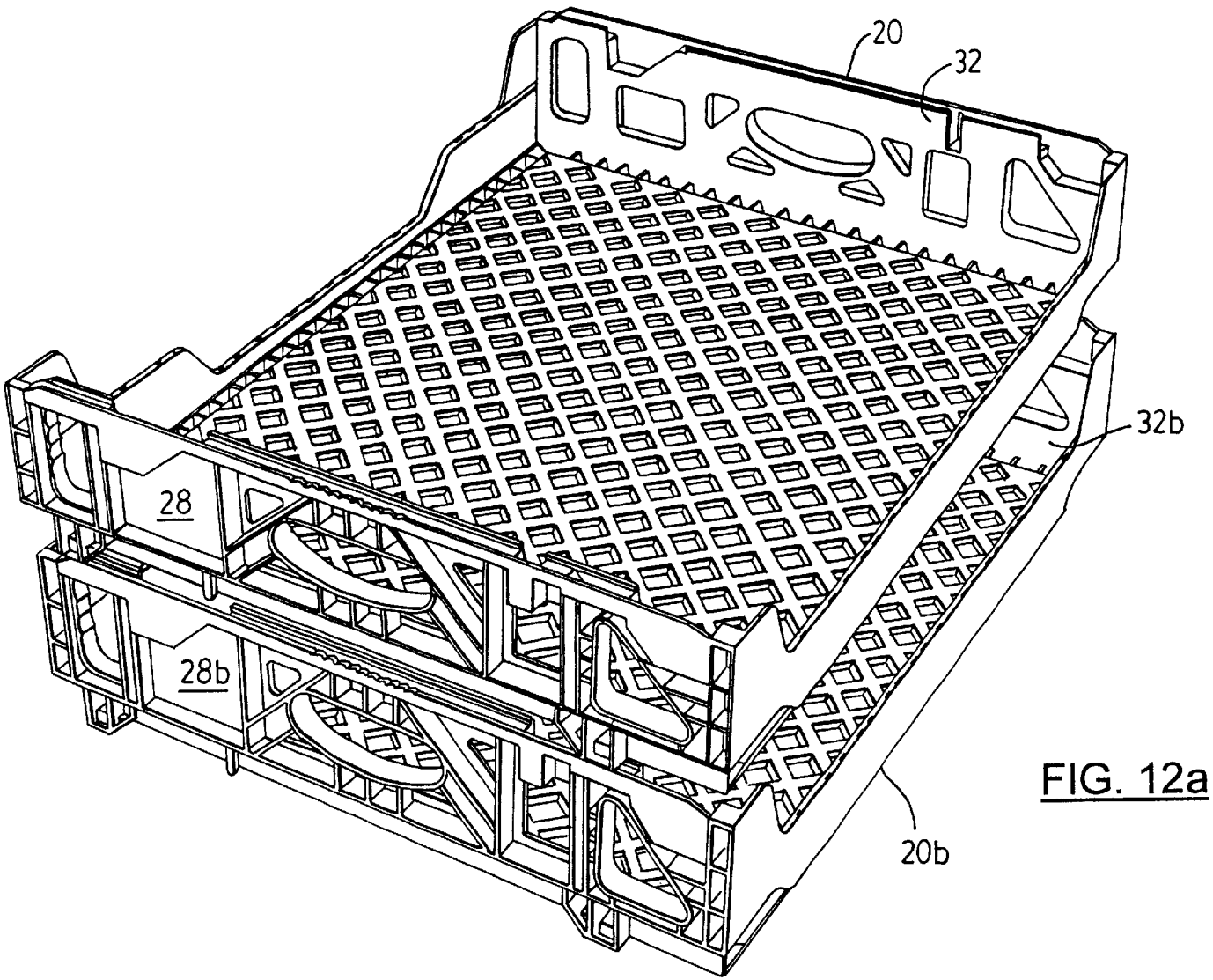
FIG. 12*a* is a top perspective view of two of the containers of FIG. 9*a* stacked in a second stacking position.
Figure 12B:
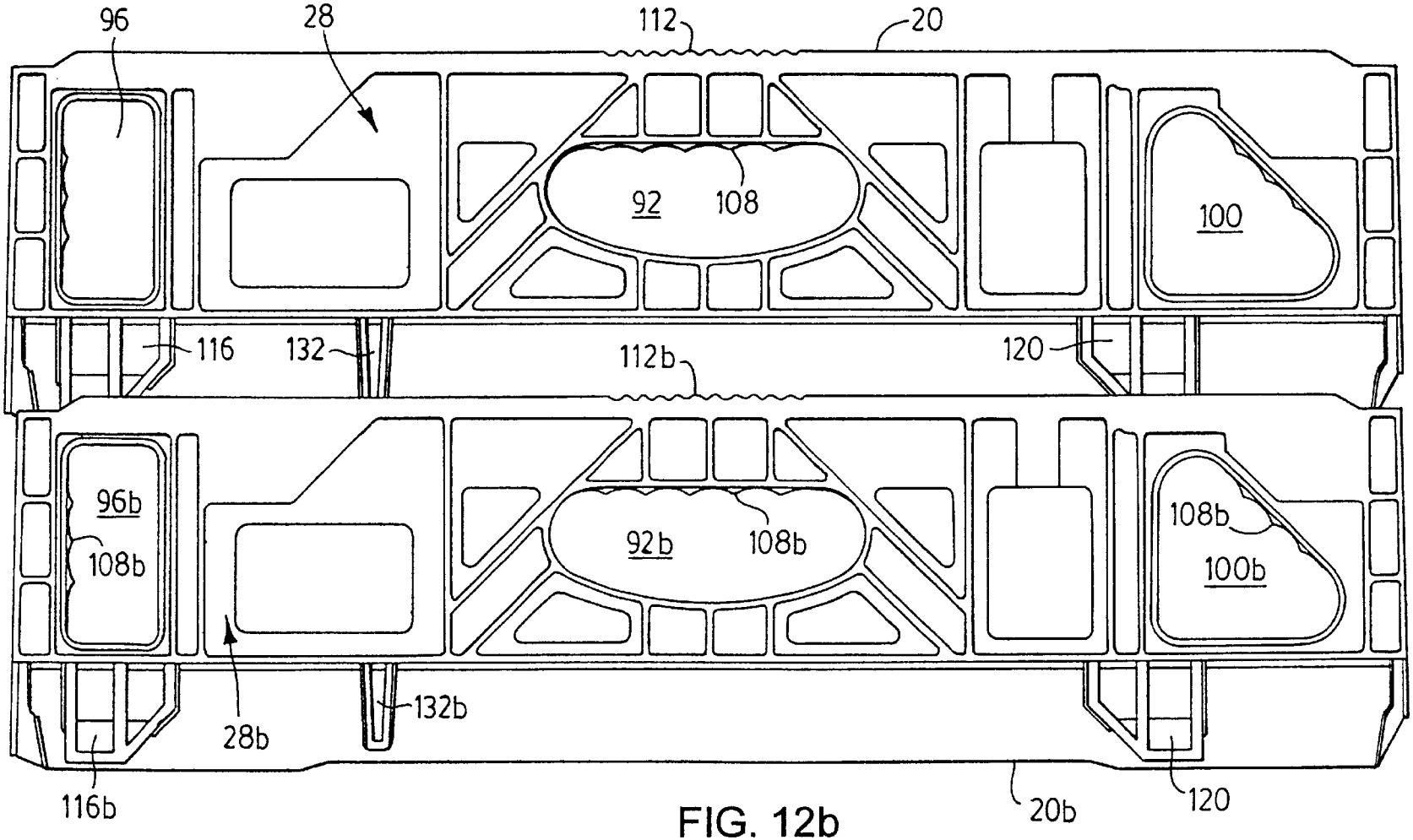
FIG. 12*b* is a side view of two of the containers stacked in the second stacking position.
Figure 12C:
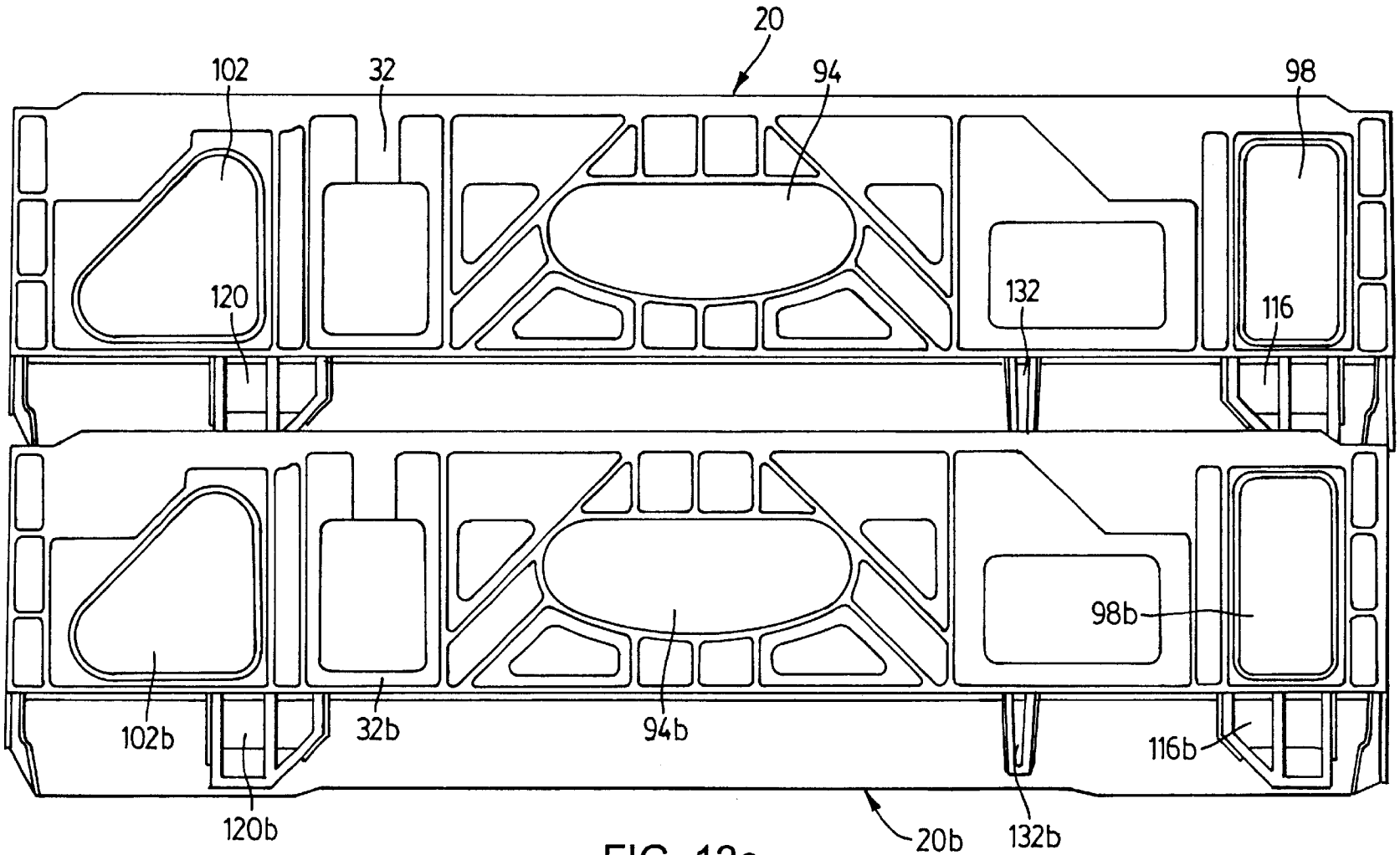
FIG. 12*c* is a side view of two of the containers, opposite the side view of FIG. 12*b*, stacked in the second stacking position.
Figure 12D:
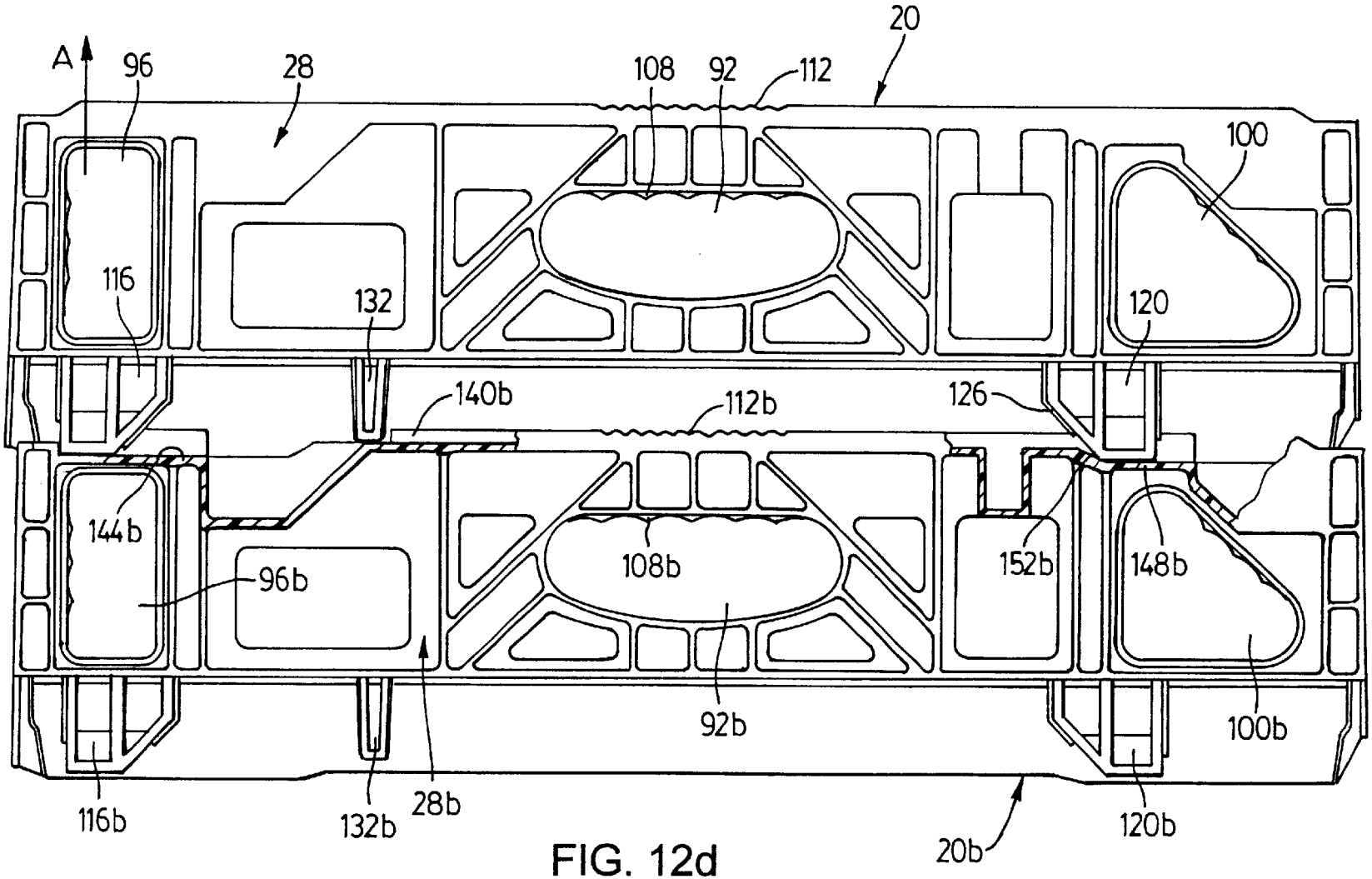
FIG. 12*d* is a partial sectional side view of two of the containers stacked in the second stacking position shown in FIG. 12*b;*
Figure 13:
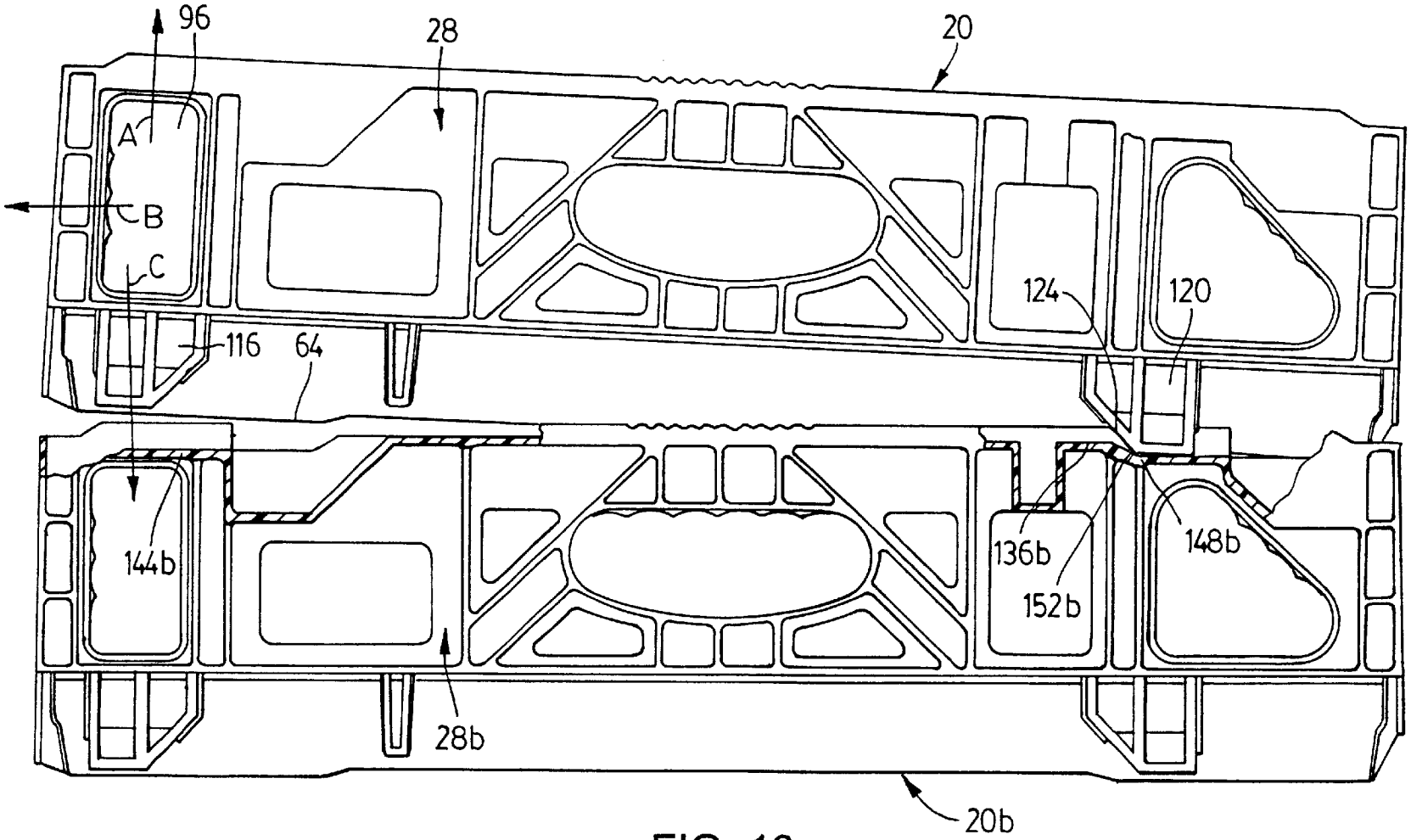
FIG. 13 is the partial sectional side view of FIG. 12*d* showing the first container in a second levered position with respect to the second container.
Figure 14:
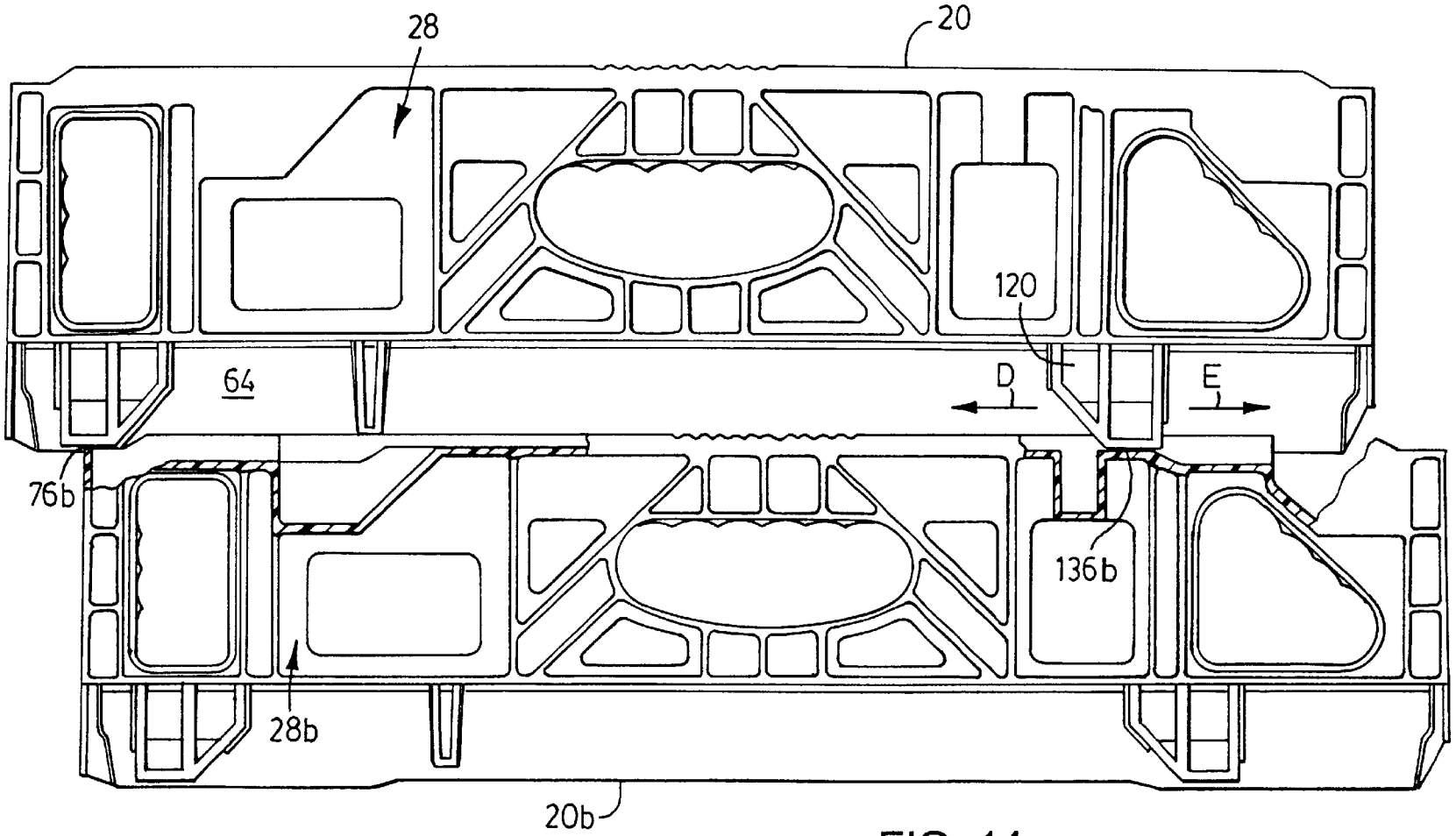
FIG. 14 is the partial sectional side view of FIG. 12*d* showing the first container in a first sliding position with respect to the second container.

Container 20 can be levered out of the second stacked position when destacking. From the second stacked position as shown in FIG. 12*d*, rectangular end handles 96, 98 are grasped and container 20 is urged in the direction of arrow A. On each of sidewall pairs 28, 28*b* and 32, 32*b*, second guide foot 120 maintains contact with depression 148*b* while first guide foot 116 is urged out of depression 144*b*. Referring to FIG. 13, container 20 is advanced in the direction of arrow B causing bevelled edge 124 of guide foot 120 to slide against bevelled edge 152*b* of depression 148*b*, thereby urging guide foot 120 out of depression 144*b* and onto rail 136*b*. Container 20 is then moved in the direction of arrow C. When container 20 is seated on container 20*b*, guide foot 120 is seated on rail 136*b* and skirt 64 is seated on flanges 76*b*, as best seen in FIG. 14. This is the second sliding position.

Referring now to FIG. 14, container 20 is in the second sliding position with guide foot 120 seated on rail 136*b* and skirt 64 seated on flanges 76*b*. Container 20 can be urged in the direction of arrow D for destacking or arrow E for stacking, by sliding guide foot 120 on rail 136*b* and skirt 64 on flanges 76*b*. With a stack of substantially identical containers 20, container 20 can be destacked by sliding in the direction of arrow D. Container 20 is thus offset from the stack and the operator can lift container 20 by grasping central handles 92, 94. Offsetting container 20 from the stack before lifting can allow the operator to remain substantially upright, without bending, when lifting the container. Alternatively, container 20 can be seated in the sliding position and then urged in the direction of arrow E for stacking. Seating the container in the sliding position before stacking, again, can allow the operator to remain substantially upright.

Figure 15A:
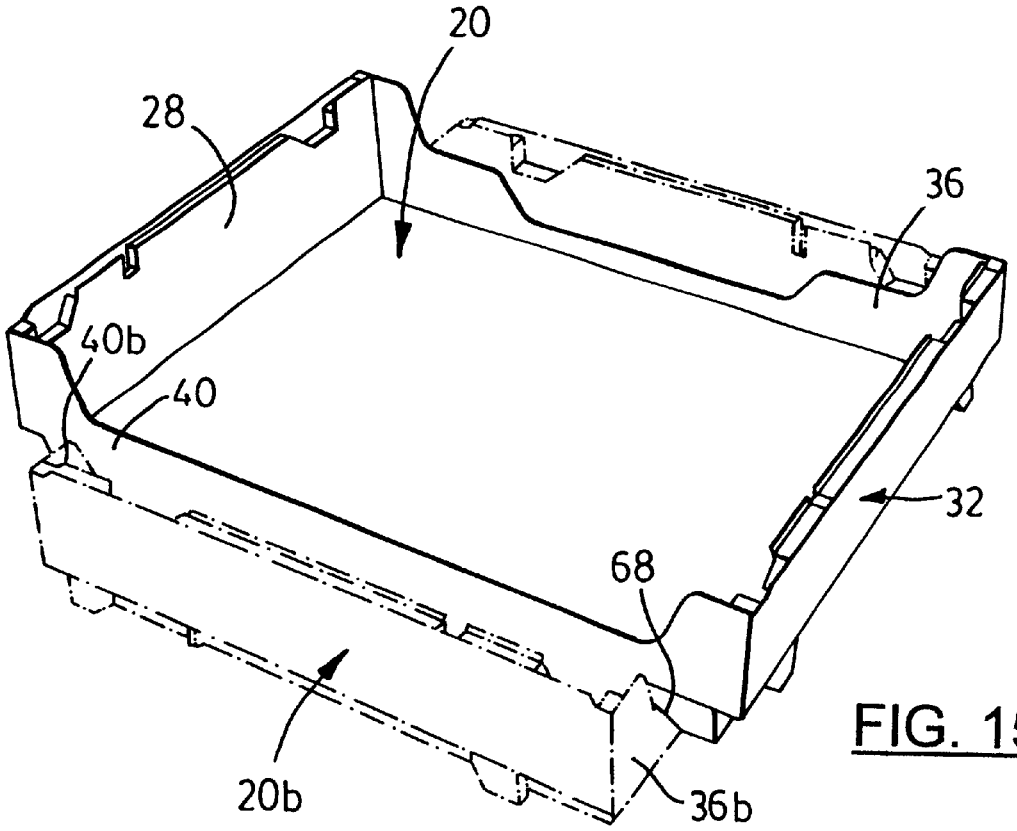
FIG. 15*a* is a top perspective view of the containers of FIG. 13*d* in a nested position.
Figure 15B:
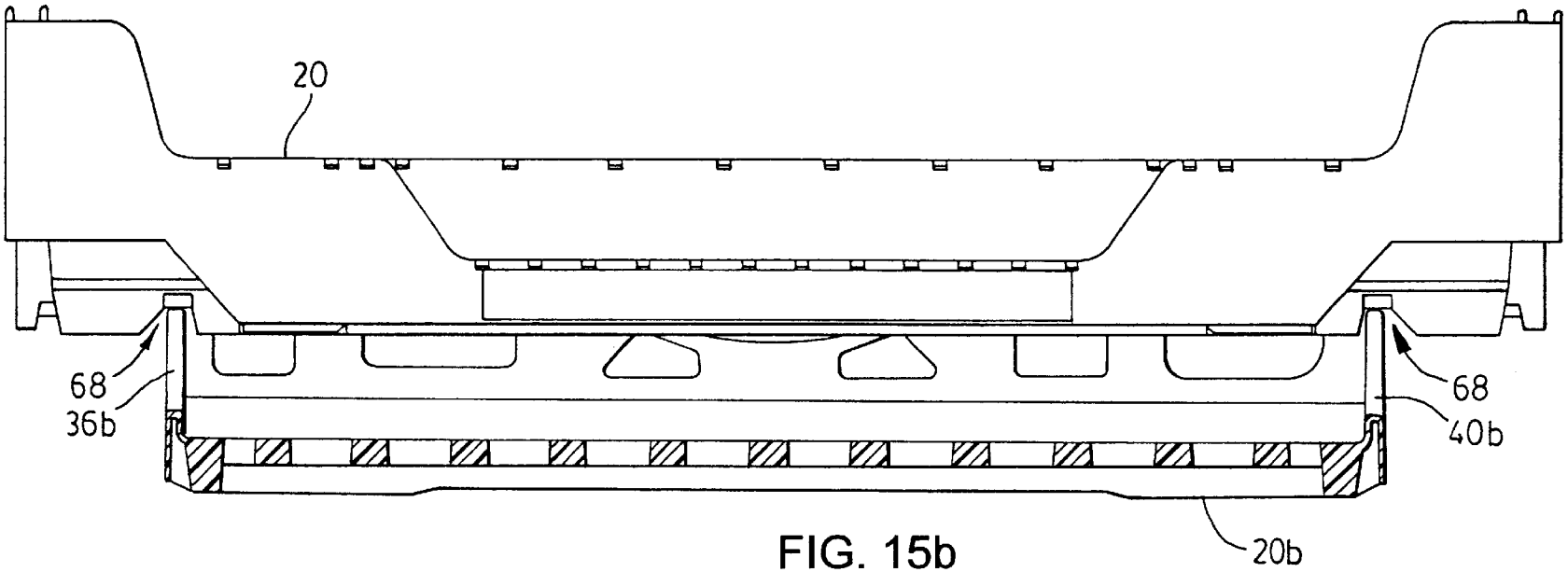
FIG. 15*b* is a sectional side view of the containers of FIG. 15*a* in the nested position.

In the nested position, shown in FIGS. 15*a* and 15*b*, container 20 is seated perpendicular to container 20*b*. Long sides 36*b*, 40*b* of container 20*b* are received by notches 68 of container 20. A stack of containers 20 in either stacked position can be lifted and moved using, for example, a two-wheeled cart. The blade of the cart is slideably received under skirt 64 of container 20 at taper 72. Tilting the cart thus lifts the stack of containers as base 24 and skirt 64 are in contact with the cart blade.

The stacking configuration of a plurality of containers 20 and the orientation of a container can be determined by the operator by using tactile or visual means. The operator can recognize sidewall 28 of container 20 by touching any of serrated edge 112 or finger grips 108 on each handle 92, 96, 100. Alternatively, the operator can recognize sidewall 28 of container 20 by visual recognition of the above mentioned features.

In a presently preferred embodiment, the first stacking position can be used for transportation and storage of buns such as hot dog or hamburger buns. The second stacking position can be used for the transportation and storage of loaves of bread. Alternatively, the container can be used for the storage and transportation of other goods such as produce or sweet goods eg. cakes.

While the embodiments discussed herein are directed to particular implementations of the present invention, it will be apparent that the subsets and variations to these embodiments are within the scope of the invention. For example, the size of the sidewalls or long sides can differ from above or may all be equal in length. Alternatively, the feet and runner positions may be interchanged with the rail, rail edge and receptacles such that the feet and runner are on the edge of the sidewall distal to the base and the rail, rail edge and receptacles may be on the edge of the sidewall adjacent the base. The container may have only one stacking position when stacked with an identical container. Also, the container may or may not have a merchandiser window on either or both of the long sides. The container may have a logotype on one side and not the other for easy identification of the stacking position. Other ribs may be added or a different arrangement of ribs may be present on the sides of the container for additional strength and rigidity. The shape of any of the features can differ while still performing the same function. Furthermore, collectively, runner 132 and feet 116, 120 can be considered to be a plurality of runners.

The present invention provides a novel container for transport or storage of products such as bread, buns, or other goods. In one embodiment, there is provided a nestable container with a base and sidewalls that can be stacked in two positions for different products and can be nested when empty for compact storage. The container has levered positions for lifting out of each stacking position and into a corresponding sliding position. The sliding positions can be used to offset the container or containers from the stack and can allow the operator to remain substantially upright, without bending, and can thus reduce the back strain on the operator when lifting for destacking. Alternatively, the container can slide in the opposite direction for stacking in either position. Thus the operator can set the container down (on the uppermost container of the stack, and offset therefrom) into the sliding position and then slide the container into the stacking position. Back strain can be reduced during stacking and destacking as the operator does not have to extend or lean over the stack to pick up or set down the containers. The container has a serrated edge on one sidewall and finger grips on each handle of the same sidewall. Thus, the orientation of the container or stacking configuration of a plurality of containers is easily recognized by either tactile or visual means. The container has a skirt with a tapered section around the periphery of the base for slideably receiving a cart when moving containers. Thus the stack of containers does not require awkward tilting and manoeuvring of the cart. Also, the front of the containers is not damaged from frequent impact with the edge of a two-wheeled cart. The base of the container is slightly bowed so that the interior is convex and is comprised of many interconnected tapered u-shaped channels. The bowed base and the tapered channels increase the strength and resistance to deformation of the base. When lifting these containers with a two-wheeled cart, pressure is applied to the base of the container. The increased strength of the base can reduce damage to the contained goods.

What is claimed is:

1. A container comprising:

a base;

at least one pair of opposing sidewalls projecting normally from said base;

said sidewalls having a rail edge distal from said base and having a plurality of receptacles;

said sidewalls having runners complementary to said receptacles and projecting from an edge adjacent said base; and, a fulcrum at a junction of said rail edge and one of said receptacles such that said container has a stacked position with an identical container when said runners are received in complementary receptacles of said identical container, a sliding position when said runners abut a rail edge of said identical container and a levered position intermediate said stacked and sliding positions when said runner respective to a fulcrum of said identical container is pivoted thereon.

2. The container according to claim 1 having a second stacked position with said identical container wherein said runners are received in complementary receptacles of an opposite one of said sidewalls of said identical container.

3. The container according to claim 2 wherein said first stacked position has a different height between said base and a base of said identical container than said second stacked position.

4. The container according to claim 3 wherein said first stacked position is for transportation and storage of buns and said second stacked position is for transportation and storage of bread.

5. The container according to claim 2 wherein said container has a second sliding position when said runners abut said rail edge on said opposite one of said sidewalls of said identical container.

6. The container according to claim 5 wherein said container has a second levered position intermediate said second stacked and said second sliding position when one of said runners respective to one of said receptacles on said opposite one of said sidewalls of said second container is pivoted thereon.

7. The container according to claim 1 wherein said container further comprises;

a skirt around the periphery of said base, interconnecting said base with said sidewalls.

8. The container according to claim 1 wherein said container further comprises;

a pair of long walls projecting normally from said base, extending between said one pair of said opposing sidewalls; and a skirt around the periphery of said base, interconnecting said base with said sidewalls and said base with said long walls;

said skirt having a plurality of notches for receiving said long walls of said second container when said container is seated perpendicular said second container.

9. The container according to claim 1 wherein said base is comprised of a grid of interconnected, inverted u-shaped channels, said unshaped channels having at least one closed end and two opposing sides.

10. The container according to claim 2 wherein said u-shaped channels are tapered such that each of said opposing sides form an angle of from about one degree to about fifteen degrees from the normal of said closed end.

11. The container according to claim 2 wherein said u-shaped channels are tapered such that each of said opposing sides form an angle of from about two degrees to about ten degrees from the normal of said closed end.

12. The container according to claim 2 wherein said u-shaped channels are tapered such that each of said opposing sides form an angle of about three degrees from the normal of said closed end.

13. The container according to claim 2 wherein each of said opposing sidewalls has at least one handle, said handle having finger grips on one of said opposing sidewalls for determining orientation of said container when stacked with said second identical container.

14. The container according to claim 2 wherein one of said opposing sidewalls has a serrated edge, said serrated edge for determining orientation of said container when stacked with said second identical container.

15. The container according to claim 7 wherein said skirt has an outward taper for slideably receiving the lifting edge of a cart when moving said container.

16. The container according to claim 8 wherein at least one of said long walls frames a merchandiser window.

17. A container comprising:

a base;

at least one pair of opposing sidewalls projecting normally from said base; said sidewalls having a base edge proximal said base and a distal edge opposite from said base edge;

one of said base edge and said distal edge having a plurality of receptacles; the opposite one of said base edge and said distal edge having a plurality of runners complementary to said receptacles;

a fulcrum at a junction of one said receptacles and its respective edge such that said container has a stacked position with an identical container when said runners are received in complementary receptacles of said identical container, a sliding position when said runners abut the opposite one of said edges of said identical container and a levered position intermediate said stacked and sliding positions when said runner respective to a fulcrum of said identical container is pivoted thereon.

18. The container according to claim 17 wherein said base edge has said receptacles and said distal edge has said runners, complementary to said receptacles.

19. A container comprising:

a base;

a pair of opposing sidewalls projecting normally from said base;

a pair of opposing long walls projecting normally from said base, extending between said pair of opposing sidewalls;

a skirt around the periphery of said base, interconnecting said base with said sidewalls and said base with said long walls, said skirt being further defined by an outward taper and a pair of notches between each of said long sides and said base;

said base comprising a grid of interconnected, inverted u-shaped channels, said u-shaped channels having at least one closed end and two opposing sides;

said sidewalls having a rail and a rail edge distal from said base and having a plurality of foot receptacles with a bevelled edge and a runner receptacle;

said sidewalls having feet with an bevelled edge, said feet being complementary to said foot receptacles and projecting from an edge adjacent said base;

said sidewalls having a runner complementary to said runner receptacle and projecting from said edge adjacent said base;

each of said opposing sidewalls having at least one handle, said handle having finger grips on one of said opposing sidewalls;

one of said opposing sidewalls having a serrated edge distal from said base, adjacent said rail;

a fulcrum at a junction of said rail edge and said runner receptacle such that said container has a first stacked position with an identical container when said feet are received in complementary foot receptacles of said identical container and said runner is received in complementary runner receptacle of said identical container, a first sliding position when said runner abuts a rail edge of said identical container, a first levered position intermediate said first stacked and said first sliding positions when said runner respective to a fulcrum of said identical container is pivoted thereon, a second stacking position when said feet are received in complementary foot receptacles of an opposite one of said sidewalls of said identical container, a second sliding position when said feet abut said rail on said opposite one of said sidewalls of said identical container, a second levered position intermediate said second stacked and said second sliding positions when one of said feet respective to one of said foot receptacles on said opposite one of said sidewalls of said second container is pivoted thereon.

* * * * *